US008479843B2

(12) United States Patent
Kriesels

(10) Patent No.: US 8,479,843 B2
(45) Date of Patent: Jul. 9, 2013

(54) SYSTEM FOR DRILLING A WELLBORE

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 298 days.

(21) Appl. No.: 12/746,998

(22) PCT Filed: Dec. 9, 2008

(86) PCT No.: PCT/EP2008/067108

§ 371 (c)(1),
(2), (4) Date: Aug. 10, 2010

(87) PCT Pub. No.: WO2009/074573

PCT Pub. Date: Jun. 18, 2009

(65) Prior Publication Data

US 2010/0294487 A1 Nov. 25, 2010

(30) Foreign Application Priority Data

Dec. 11, 2007 (EP) ..... 07122905

(51) Int. Cl.
*E21B 43/00* (2006.01)

(52) U.S. Cl.
USPC ..... 175/171; 175/257; 166/380; 166/206; 166/207; 166/208

(58) Field of Classification Search
USPC ..... 166/380, 206, 207, 208, 242.2, 242.3; 175/257, 171
See application file for complete search history.

(56) References Cited

U.S. PATENT DOCUMENTS

| | | | | |
|---|---|---|---|---|
| 2,927,775 | A | 3/1960 | Hildebrandt | 255/72 |
| 3,674,100 | A | 7/1972 | Becker | 175/69 |
| 4,501,337 | A * | 2/1985 | Dickinson et al. | 175/171 |
| 5,803,666 | A | 9/1998 | Keller | 405/146 |
| 7,387,174 | B2 * | 6/2008 | Lurie | 175/57 |
| 7,946,349 | B2 * | 5/2011 | Kriesels | 166/384 |
| 8,056,641 | B2 * | 11/2011 | Kriesels et al. | 166/384 |
| 8,056,642 | B2 * | 11/2011 | Kriesels et al. | 166/384 |
| 8,141,647 | B2 * | 3/2012 | Kriesels et al. | 166/380 |
| 2007/0107941 | A1 | 5/2007 | Fillipov et al. | 175/57 |
| 2009/0255689 | A1 * | 10/2009 | Kriesels et al. | 166/384 |
| 2009/0288842 | A1 * | 11/2009 | Kriesels | 166/384 |
| 2010/0089593 | A1 * | 4/2010 | Hou et al. | 166/384 |

(Continued)

FOREIGN PATENT DOCUMENTS

| | | |
|---|---|---|
| EP | 0044706 | 1/1982 |
| WO | WO03036025 | 5/2003 |
| WO | WO 2005024178 A1 * | 3/2005 |

*Primary Examiner* — Jennifer H Gay
*Assistant Examiner* — Elizabeth Gitlin

(57) ABSTRACT

A system for drilling a wellbore into an earth formation comprises an expandable tubular element extending into the wellbore, wherein a lower end portion of the wall of the tubular element extends radially outward and in an axially reverse direction so as to define an expanded tubular section extending around a remaining tubular section of the tubular element. The expanded tubular section is extendable by downward movement of the remaining tubular section relative to the expanded tubular section whereby said lower end portion of the wall bends radially outward and in an axially reverse direction. A drill string extends through the remaining tubular section into the wellbore, such that a space is formed between the drill string and the remaining tubular section, and the system further comprises sealing means arranged to seal said space from an open-hole lower section of the wellbore.

9 Claims, 1 Drawing Sheet

U.S. PATENT DOCUMENTS

2010/0252333 A1* 10/2010 Blange et al. ..... 175/424
2010/0276202 A1* 11/2010 Kriesels ..... 175/61
2010/0294487 A1* 11/2010 Kriesels ..... 166/207
2010/0331959 A1* 12/2010 Kriesels et al. ..... 623/1.15

* cited by examiner

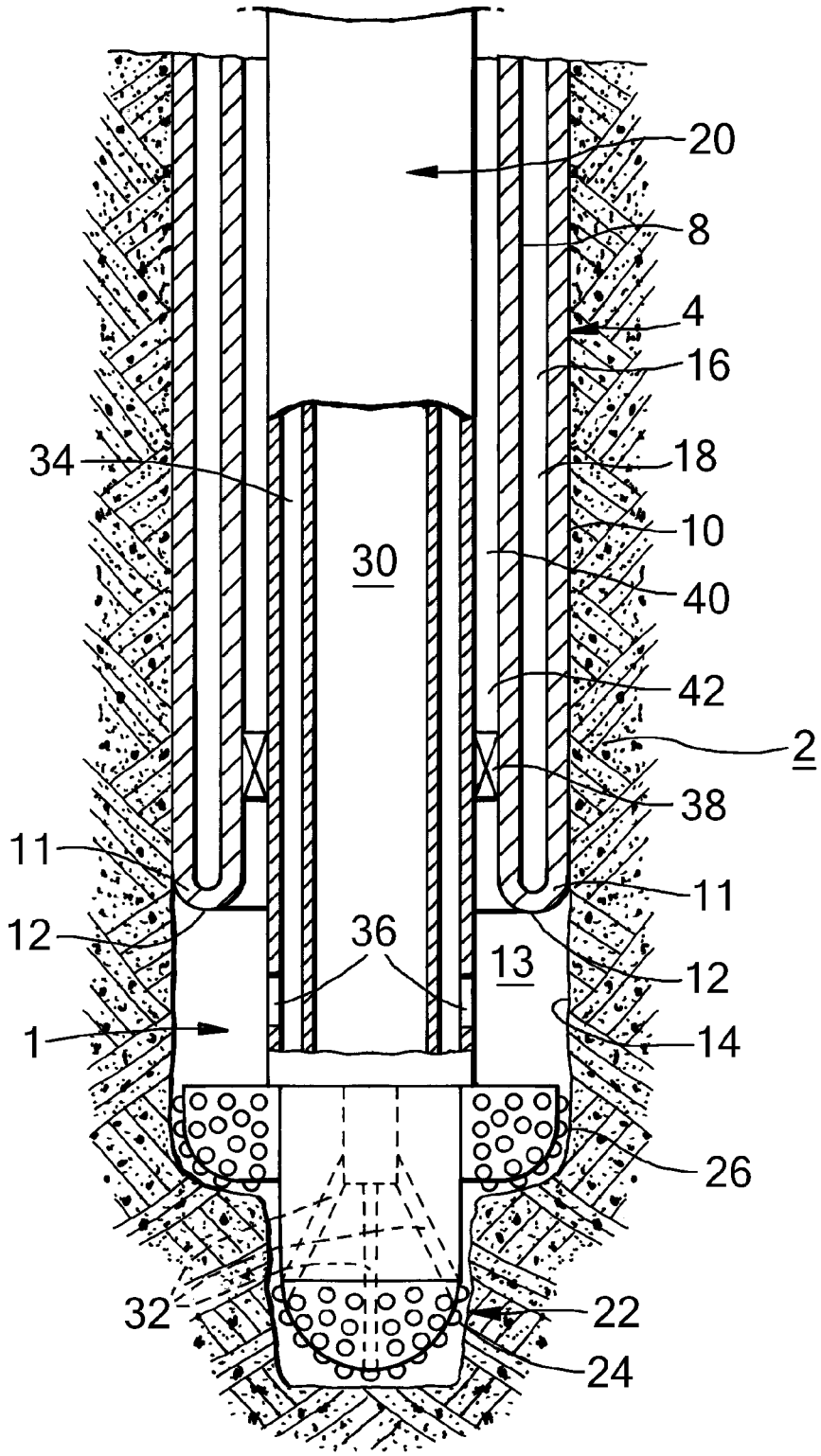
20
8
4
16
34
18
10
30
40
42
2
38
11
11
12
36
13
12
1
14
26
32
22
24

SYSTEM FOR DRILLING A WELLBORE

PRIORITY CLAIM

The present application claims priority to PCT Application EP2008/067108, filed 9 Dec. 2008, which claims priority to European Patent Application No. EP 07122905.8, filed 11 Dec. 2007.

TECHNICAL FIELD OF THE INVENTION

The present invention relates to a system for drilling a wellbore into an earth formation whereby an expandable tubular element extends into the wellbore.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a certain depth further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved system for drilling a wellbore whereby an expandable tubular element extends into the wellbore.

SUMMARY OF THE INVENTION

In accordance with the invention there is provided a system for drilling a wellbore into an earth formation, comprising an expandable tubular element extending into the wellbore, whereby a lower end portion of the wall of the tubular element extends radially outward and in axially reverse direction so as to define an expanded tubular section extending around a remaining tubular section of the tubular element, the expanded tubular section being extendable by downward movement of the remaining tubular section relative to the expanded tubular section whereby said lower end portion of the wall bends radially outward and in axially reverse direction;

a drill string extending through the remaining tubular section into the wellbore, whereby a space is formed between the drill string and the remaining tubular section.

sealing means arranged to seal said space from an open-hole lower section of the wellbore.

By moving the remaining tubular section downward relative to the expanded tubular section during drilling, the tubular element is effectively turned inside out whereby the lower end portion of the wall of the tubular element is continuously bent radially outward and in axially reverse direction so that the tubular element is progressively expanded without the need for an expander that is pushed, pulled or pumped through the tubular element. In this manner the expanded tubular section forms a casing or liner that is installed in the wellbore during the drilling process, so that a relatively short open-hole section can be maintained during drilling.

Furthermore, by virtue of the sealing means it is achieved that the space between the drill string and the remaining tubular section is sealed from the drilling fluid in the open-hole wellbore section. This allows the pressure on the inside of the remaining tubular section to be controlled independently from the drilling fluid pressure.

It is preferred that said space contains a body of fluid exerting an inner pressure to the remaining tubular section.

Suitably an annulus is defined between the remaining tubular section and the expanded tubular section, said annulus containing a volume of fluid exerting an outer pressure to the remaining tubular section. The density of the body of fluid in the annular space is preferably substantially equal to the density of the volume of fluid in the annulus so that, at each depth level, the inner pressure is substantially equal to the outer pressure.

To circulate drilling fluid through the wellbore, it is preferred that the drill string includes a first conduit for pumping drilling fluid into said open-hole section and a second conduit for discharging drilling fluid from said open-hole section.

Suitably the remaining tubular section and the drill string are arranged for simultaneous lowering through the wellbore.

It is preferred that the wall of the tubular element includes a material that is plastically deformed during the bending process, so that the expanded tubular section retains an expanded shape as a result of said plastic deformation. Thus, there is no need for an external force or pressure to be applied to the expanded tubular section to maintain its expanded form. If, for example, the expanded tubular section is expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

Suitably the remaining tubular section is induced to move downward while the expanded tubular section is kept stationary in the wellbore.

In order to induce said downward movement it is preferred that the remaining tubular section is subjected to an axially compressive force, which at least partly can result from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling of the wall.

Suitably the remaining tubular section is axially extended at its upper end in correspondence with its downward movement. This can be done, for example, by adding tubular portions at the upper end in any suitable manner such as by welding. Alternatively, the remaining tubular section can be formed as a coiled tubing which is unreeled from a reel and subsequently inserted into the wellbore. In this way the process of eversion of the tubular element can be continued until a desired length of the tubular element is expanded.

Optionally the bending zone can be heated to promote bending of the tubular wall.

BRIEF DESCRIPTION OF THE DRAWING

The invention will be described hereinafter in more detail and by way of example, with reference to the accompanying drawing in which:

FIG. 1 schematically shows a lower portion of an embodiment of the system of the invention.

In the drawing and the description, like reference numerals relate to like components.

DETAILED DESCRIPTION OF THE PREFERRED EMBODIMENTS

Referring to FIG. 1 there is shown a system including a wellbore 1 extending into an earth formation 2, and a tubular element in the form of liner 4 extending from surface downwardly into the wellbore 1. The liner 4 has been partially radially expanded by eversion of the wall of the liner whereby a radially expanded tubular section 10 of the liner 4 has been formed, which has an outer diameter substantially equal to the wellbore diameter. A remaining tubular section of the liner 4, in the form of unexpanded liner section 8, extends concentrically within the expanded tubular section 10.

The wall of the liner 4 is, due to eversion at its lower end, bent radially outward and in axially reverse (i.e. upward) direction so as to form a U-shaped lower section 11 of the liner interconnecting the unexpanded liner section 8 and the expanded liner section 10. The U-shaped lower section 11 of the liner 4 defines a bending zone 12 of the liner.

The expanded liner section 10 is axially fixed to the wellbore wall 14 by any suitable anchoring means (not shown), or by frictional forces between the expanded liner section 10 and the wellbore wall 14 resulting from the expansion process. The U-shaped lower portion 11 of liner 4 is positioned a short distance above the bottom of the wellbore so that an open-hole section 13 of the wellbore is defined below the U-shaped lower section 11. An annulus 16, containing a volume of fluid 18, is formed between the unexpanded liner section 8 and the expanded liner section 10.

A drill string 20 extends from surface through the unexpanded liner section 8 to the bottom of the wellbore 1. The drill string 20 is at its lower end provided with a drill bit 22 comprising a pilot bit 24 with gauge diameter slightly smaller than the internal diameter of the unexpanded liner section 8, and a reamer section 26 with gauge diameter adapted to drill the wellbore 1 to its nominal diameter. The reamer section 26 is radially retractable to an outer diameter allowing it to pass through unexpanded liner section 8, so that the drill string 20 can be retrieved through the unexpanded liner section 8 to surface. The drill string 20 is internally provided with a first fluid conduit 30 for pumping drilling fluid from surface, via nozzles 32 at the drill bit 22, into the open-hole wellbore section 13, and a second fluid conduit 34 for discharging drilling fluid from the open-hole wellbore section 13. The second fluid conduit 34 extends concentrically around the first fluid conduit 30 and has a series of inlet openings 36 near its lower end.

The outer surface of the drill string 20 is provided with an annular seal 38 arranged to seal the open-hole wellbore section 13 from an annular space 40 formed between the drill string 20 and the unexpanded liner section 8. The annular seal 38 is located near the lower end of the liner 4 and allows the unexpanded liner section 8 to slide along the seal 38. The annular space 40 is filled with a body of fluid 42 of a selected specific weight such that the load exerted to the unexpanded liner section 8 by the body of fluid 42 and the volume of fluid 18 does not exceed the burst rating or the collapse rating of unexpanded liner section 8. Suitably the specific weight of body of fluid 42 is substantially equal to the specific weight of the volume of fluid 18.

During normal operation, a lower end portion of the liner 4 is initially everted. That is, the lower end portion is bent radially outward and in axially reverse direction. The U-shaped lower section 11 and a short length of the expanded liner section 10 are thereby initiated. Subsequently, the expanded liner section 10 thus formed is anchored to the wellbore wall 14 by the anchoring means. Alternatively, depending on the geometry and/or material properties of the liner 4, the expanded liner section 10 becomes anchored to the wellbore wall automatically by virtue of friction forces between the expanded liner section 10 and the wellbore wall 14.

A downward force is then applied to the unexpanded liner section 8 so as to move the unexpanded liner section 8 gradually downward. As a result, the unexpanded liner section 8 is progressively everted so that the unexpanded liner section 8 is progressively transformed into the expanded liner section 10. The bending zone 12 moves in downward direction during the eversion process at approximately half the speed of movement of the unexpanded liner section 8.

If desired, the diameter and/or wall thickness of the liner 4 can be selected such that the expanded liner section 10 is pressed against the wellbore wall 14 as a result of the expansion process so as to seal against the wellbore wall and/or to stabilize the wellbore wall.

Since the length, and hence the weight, of the unexpanded liner section 8 gradually increases, the magnitude of the downward force can be gradually lowered in correspondence with the increasing weight of liner section 8. Eventually, the downward force may need to be replaced by an upward force to prevent buckling of liner section 8.

The unexpanded liner section 8 is at its upper end extended in correspondence with its downward movement, for example by adding tubular sections to the liner, or by continuously forming the liner from metal sheet on a reel.

Simultaneously with downward movement of the unexpanded liner section 8 into the wellbore, the drill string 20 is operated to rotate the drill bit 22 and thereby deepen the wellbore 1 by further drilling. The drill string 20 thereby gradually moves downward into the wellbore 1. The unexpanded liner section 8 is moved downward in a controlled manner and at substantially twice the speed of lowering of the drill string 20, so that it is ensured that the bending zone 12 remains at a short distance above the drill bit 22. Controlled lowering of the unexpanded liner section 8 can be achieved, for example, by controlling the downward force, or upward force, referred to hereinbefore. Suitably, the unexpanded liner section 8 is supported by the drill string 20, for example by means of a bearing device (not shown) connected to the drill string, which supports the U-shaped lower section 11. In that case the upward force is suitably applied to the drill string 20 at surface, whereby the force is transmitted to the unexpanded liner section 8 at the bearing device. Also, the weight of the unexpanded liner section 8, if transferred to the drill string by the bearing means, provides a thrust force to the drill bit 22.

During operation of the drill string 20, a stream of drilling fluid is pumped from surface via the first fluid conduit 30 and the nozzles 32, into the open-hole wellbore section 13 where drill cuttings are entrained in the drilling fluid. The stream of drilling fluid then flows via the inlet openings 36 into the second fluid conduit 34 through which the stream is discharged to surface. Alternatively, the stream of drilling fluid can be pumped in reverse circulation mode whereby the stream is pumped from surface into the second fluid conduit 34, and discharged from the wellbore via the first fluid conduit 30.

The volume of fluid 18 in the annulus 16 exerts a hydrostatic pressure acting on the inner surface of the expanded liner section 10 thereby increasing the collapse resistance of the expanded liner section 10. The hydrostatic pressure also acts on the outer surface of the unexpanded liner section 8, however this pressure is at least partially compensated by a hydrostatic pressure from the body of fluid 42 acting on the inner surface of the unexpanded liner section 8. It is thus achieved that the collapse loading on the unexpanded liner section 8 is not negatively affected by the hydrostatic pressure from the volume of fluid 18 in annulus 16.

A further advantage of the system of the invention becomes apparent during underbalanced drilling whereby the drilling fluid pressure is slightly below the pore pressure and gas from the earth formation enters the wellbore. The inflowing gas lowers the density of the drilling fluid, therefore a relatively high back-pressure must be applied to the return fluid stream to control the drilling operation. Since the return fluid stream flows through the second fluid conduit of the drill string, rather than through the annular space between the drill string and the liner, the unexpanded liner section does not become exposed to the high fluid back-pressure.

In view of the above it is concluded that, with the system of the invention, the collapse resistance of the expanded liner section is improved and the load on the unexpanded liner section remains relatively low. This enables the use of a liner with relatively small wall thickness thus improving the capability of the liner of being everted.

When it is required to retrieve the drill string 20 to surface, for example when the drill bit 22 is to be replaced or when drilling of the wellbore 1 is complete, the reamer section 26 brought to its radially retracted mode. Subsequently the drill string 20 is retrieved through the unexpanded liner section 8 to surface.

With the system of the invention, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface.

In case the length of unexpanded liner section is left in the wellbore, there are several options for completing the wellbore. These are, for example, as outlined below.

A) A fluid, for example brine, is pumped into the annulus between the unexpanded and expanded liner sections so as to pressurise the annulus and increase the collapse resistance of the expanded liner section. Optionally one or more holes are provided in the U-shaped lower section to allow the pumped fluid to be circulated.

B) A heavy fluid is pumped into the annulus so as to support the expanded liner section and increase its collapse resistance.

C) Cement is pumped into the annulus in order to create, after hardening of the cement, a solid body between the unexpanded liner section and the expanded liner section, whereby the cement may expand upon hardening.

D) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, suitably a friction reducing layer, such as a Teflon layer, is applied between the unexpanded and expanded liner sections. For example, a friction reducing coating can be applied to the outer surface of the liner before expansion. Such layer of friction reducing material furthermore reduces the annular clearance between the unexpanded and expanded sections, which results in a reduced tendency of the unexpanded section to buckle. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described), the expanded liner section can be expanded against the inner surface of another tubular element already present in the wellbore.

Instead of using a drill string with concentric first and second fluid conduits (as described), the first and second fluid conduits can be formed as parallel flow passages. For example the drill string can be formed as an assembly of separate parallel drill strings, which may, or may not, be connected to each other.

The invention claimed is:

1. A system for drilling a wellbore into an earth formation, comprising:

an expandable tubular element extending into the wellbore, wherein a lower end portion of the wall of the tubular element extends radially outward and in an axially reverse direction so as to define an expanded tubular section extending around a remaining tubular section of the tubular element, the expanded tubular section being extendable by downward movement of the remaining tubular section relative to the expanded tubular section whereby the lower end portion of the wall bends radially outward and in an axially reverse direction;

a drill string extending through the remaining tubular section into the wellbore, such that a space is formed between the drill string and the remaining tubular section, the space containing a body of fluid exerting an inner pressure to the remaining tubular section, the drill string comprising a first fluid conduit for drilling fluid from surface into a open-hole wellbore section and a second fluid conduit for discharging drilling fluid from the open-hole wellbore second such that a return fluid stream flows through the second fluid conduit and not through the space between the drill string and the remaining tubular section; and sealing means arranged to seal the space from the open-hole lower section of the wellbore.

2. The system of claim 1, wherein an annulus is defined between the remaining tubular section and the expanded tubular section, the annulus containing a volume of fluid exerting an outer pressure to the remaining tubular section.

3. The system of claim 2, wherein, at each depth level, the inner pressure and outer pressure exert a load to the remaining tubular section, the load being smaller than at least one of a collapse load and a burst load of the remaining tubular section.

4. The system of claim 1, wherein the first conduit and the second conduit are substantially concentrically arranged.

5. The system of claim 1, wherein the space is an annular space.

6. The system of claim 1, wherein the remaining tubular section and the drill string are arranged so as to be simultaneously lowered in the wellbore.

7. The system of claim 1, wherein the wall of the tubular element includes a material susceptible of plastic deformation during the bending of the wall so that the expanded tubular section retains an expanded shape as a result of the plastic deformation.

8. The system of claim 1, wherein the remaining tubular section is subjected to an axially compressive force acting to induce the downward movement of the remaining tubular section.

9. The system of claim 8, wherein the axially compressive force is at least partly due to the weight of the remaining tubular section.

* * * * *